US006075366A

United States Patent [19]

Yasuda

[11] Patent Number: 6,075,366

[45] Date of Patent: Jun. 13, 2000

[54] ION CURRENT DETECTION APPARATUS FOR AN INTERNAL COMBUSTION ENGINE

[75] Inventor: Yukio Yasuda, Tokyo, Japan

[73] Assignee: Mitsubishi Denki Kabushiki Kaisha, Tokyo, Japan

[21] Appl. No.: 09/070,723

[22] Filed: May 1, 1998

[30] Foreign Application Priority Data

Nov. 26, 1997 [JP] Japan ..... 9-324354

[51] Int. Cl.[7] ..... F02P 17/12

[52] U.S. Cl. ..... 324/380; 324/388; 324/464; 73/35.08; 73/116

[58] Field of Search ..... 324/380, 382, 324/388, 464; 73/35.08, 116, 117.2, 117.3

[56] References Cited

U.S. PATENT DOCUMENTS

| | | | |
|---|---|---|---|
| 5,534,781 | 7/1996 | Lee et al. | 324/380 |
| 5,548,220 | 8/1996 | Kawamoto et al. | 324/399 |
| 5,781,012 | 7/1998 | Yasuda | 324/399 |
| 6,011,397 | 1/2000 | Yasuda | 324/388 |

FOREIGN PATENT DOCUMENTS

| | | |
|---|---|---|
| 4-191466 | 7/1992 | Japan . |
| 8-135553 | 5/1996 | Japan . |
| 9-015101 | 1/1997 | Japan . |
| 9-079126 | 3/1997 | Japan . |

*Primary Examiner*—Glenn W. Brown
*Attorney, Agent, or Firm*—Oblon, Spivak, McClelland, Maier & Neustadt, P.C.

[57] ABSTRACT

An ion current detection apparatus for an internal combustion engine includes a voltage limiting device for limiting an amount of counterelectromotive force of a primary coil of ignition coil applied to switching elements, a capacitor for applying an ion current detection voltage to a spark plug, and an ion current detection circuit for detecting an ion current wherein the capacitor is connected to the voltage limiting device.

10 Claims, 6 Drawing Sheets

ION CURRENT DETECTION APPARATUS FOR AN INTERNAL COMBUSTION ENGINE

BACKGROUND OF THE INVENTION

1. Field of the Invention

The present invention relates to an ion current detection apparatus for detecting the combustion condition of an internal combustion engine by detecting ionization, by way of an ion current, of combustion gas resulting from combustion in an internal combustion engine.

2. Description of Related Art

FIG. 10 is a circuit diagram of a conventional apparatus comprising an ion current detection apparatus 300 for the ignition apparatus 200 of an internal combustion engine. The ignition apparatus 200 comprises a motor vehicle battery or other electrical power supply 201, an ignition coil 202, ignition control circuit 203, and a spark plug 204. The ignition control circuit 203 comprises a switching circuit 210, a resistor 211, and a control circuit unit 212 for controlling the switching circuit 210.

The switching circuit 210 comprises npn power transistors 215 and 216 in a compound connection, zener diode 217, and resistors 218 and 219.

The ion current detection apparatus 300 comprises an ion current detection circuit unit 301 for detecting an ion current, a capacitor 302, and a zener diode 303.

Referring to the ignition apparatus 200, current is supplied from the electrical power supply 201 to one end of the primary coil La of the ignition coil 202; the other end of the primary coil La is grounded through the ignition control circuit 203. One end of the secondary coil Lb of the ignition coil 202 is grounded through the spark plug 204, and the other end is connected to the ion current detection apparatus 300, that is, to the cathode of the zener diode 303 and to one side of the capacitor 302. The anode of the zener diode 303 is grounded, and the other side of the capacitor 302 is connected to the ion current detection circuit unit 301. It should be noted that the anode of the zener diode 303 is shown grounded in FIG. 10, but can be alternatively connected to the ion current detection circuit unit 301.

The cathode of zener diode 217 is connected to the collector of power transistor 216, and the anode is connected to the base of power transistor 216, to protect power transistors 215 and 216 from counterelectromotive force from the primary coil La of the ignition coil 202. The junction between the resistor 211 and emitter of power transistor 215, and the grounded side of the resistor 211, are connected to the control circuit unit 212. A control signal from the engine control unit (not shown in the figure) is input to the control circuit unit 212 for controlling the ignition timing based on various engine operation information. The control circuit unit 212 controls the switching operation of the power transistors 215 and 216 based on the supplied control signal.

When the power transistors 215 and 216 are switched on by a control signal from the engine control unit (ECU below) in this configuration, a current of up to between ten and twenty amperes flows to the primary coil La of the ignition coil 202. A counterelectromotive force then occurs between the primary coil La and the power transistors 215 and 216 when the current supply from the primary coil La is suddenly cut off as a result of the power transistors 215 and 216 switching off in response to a control signal from the ECU after supplying current to the primary coil La for a specified time. The zener diode 217, however, normally limits the power supply between the collector and base of the power transistor 216 to approximately 300–400 V.

When a counterelectromotive force occurs at the primary coil La of the ignition coil 202, a voltage proportional to the winding ratio between the primary coil La and secondary coil Lb occurs at the secondary coil Lb. For example, because the number of windings in the secondary coil Lb is approximately 100 times the number of windings in the primary coil La, a voltage of approximately 30 kV occurs at the secondary coil Lb. The secondary coil Lb is connected such that a negative voltage occurs on the spark plug 204 side of the coil, and a positive voltage occurs on the side on which the capacitor 302 and zener diode 303 are connected. If the voltage stored by the capacitor 302 is less than or equal to the zener voltage of the zener diode 303 when the spark plug 204 sparks, a current of several ten milliamperes to a hundred and several ten milliamperes flows to the capacitor 302; if said stored voltage exceeds the zener voltage, the current flows from the cathode to the anode of zener diode 303.

As thus described, the counterelectromotive force of the primary coil La of the ignition coil 202 rapidly attenuates, the voltage at both ends of the secondary coil Lb also simultaneously drops rapidly, and the voltage at both ends of the secondary coil Lb drops ultimately to zero after ignition. The voltage stored in the capacitor 302 is then added to the potential of the secondary coil Lb, becomes approximately equal to the zener voltage of the zener diode 303 during the ignition operation, and a voltage equal to the zener voltage of the zener diode 303 is applied to the spark plug 204.

When a voltage comparable to the stored charge of the capacitor 302 is applied to the spark plug 204 inside a cylinder containing ionized combustion gases immediately after ignition, an ion current flows. Because capacitor 302 supplies this ion current, a current matching the ion current also flows to the ion current detection circuit unit 301 connected to the capacitor 302. This current is detected, and the signal contained in the ion current is processed.

The ion current is known to react to minute changes in the temperature and pressure inside the cylinder, and a device for detecting whether normal combustion is occurring by comparing the absolute value of this ion current has been disclosed in Japanese Patent Laid-Open Publication H7-217519 (1995-217519) filed by an inventor of the present invention. A circuit for extracting an oscillation wave component superimposed on this ion current as a means of detecting knocking caused by abnormal pressure inside the cylinder is also disclosed in Japanese Patent Laid-Open Publication H9-15101 (1997-15101), also filed by an inventor of the present invention.

With a conventional ion current detection apparatus, however, a voltage limiting element, such as a zener diode 303 for limiting the voltage of the capacitor 302 supplying the ion current, is required for each capacitor 302, and a significant power loss occurs due to the several ten milliampere to a hundred and several ten milliampere current and the approximately 100–400 V limit voltage flowing during ignition. The zener diode 303 or other voltage limiting element must be built with a heat radiation design sufficient to withstand such a power loss, thus contributing to increased cost.

SUMMARY OF THE INVENTION

An object of the present invention is therefore to eliminate a zener diode voltage limiting element used in an ion current detection apparatus disposed in an ignition apparatus of an internal combustion engine.

More specifically, the present invention uses a voltage limiting element disposed in an ignition control circuit as a voltage limiting element of an ion current detection apparatus. This is possible because ion current detection occurs during the period in which the power transistor of the ignition control circuit is off. As a result, voltage limiting of the counterelectromotive force in the primary coil, and voltage limiting for the capacitor in the ion current detection apparatus, do not occur simultaneously even though a common voltage limiting element is used for both operations.

To achieve the above object, an ion current detection apparatus for detecting an ion current occurring during combustion in an internal combustion engine, where the internal combustion engine comprises an ignition coil for generating a high voltage charge on the secondary coil thereof by means of a voltage applied to the primary coil thereof, and a spark plug for igniting fuel inside an engine cylinder as a result of the high voltage generated in the ignition coil, includes a voltage limiting device for limiting the counterelectromotive force of the primary coil to the switching elements used for controlling current supply to the primary coil; a capacitor for applying an ion current detection voltage to a spark plug via secondary coil; an ion current detection means for detecting an ion current based on a voltage applied from the capacitor to the spark plug; and a connecting means for connecting the capacitor to the voltage limiting device; wherein the voltage limiting device is also used for capacitor voltage limiting.

The capacitor in the present invention is preferably charged by current flowing during sparking of the spark plug, and discharges the stored voltage charge to the spark plug immediately after ignition, and the voltage limiting means limits the voltage supplied to the capacitor during capacitor charging.

The connecting means of the present invention can comprise a first diode for connecting the primary coil and switching element in a forward direction, and a second diode for connecting said capacitor and voltage limiting means in a forward direction.

Further preferably, the voltage limiting means of the present invention is a zener diode.

Other objects and attainments together with a fuller understanding of the invention will become apparent and appreciated by referring to the following description and claims taken in conjunction with the accompanying drawings.

DESCRIPTION OF THE PREFERRED EMBODIMENTS

The preferred embodiments of the present invention are described below with reference to the accompanying figures.

Embodiment 1

Figure 1:
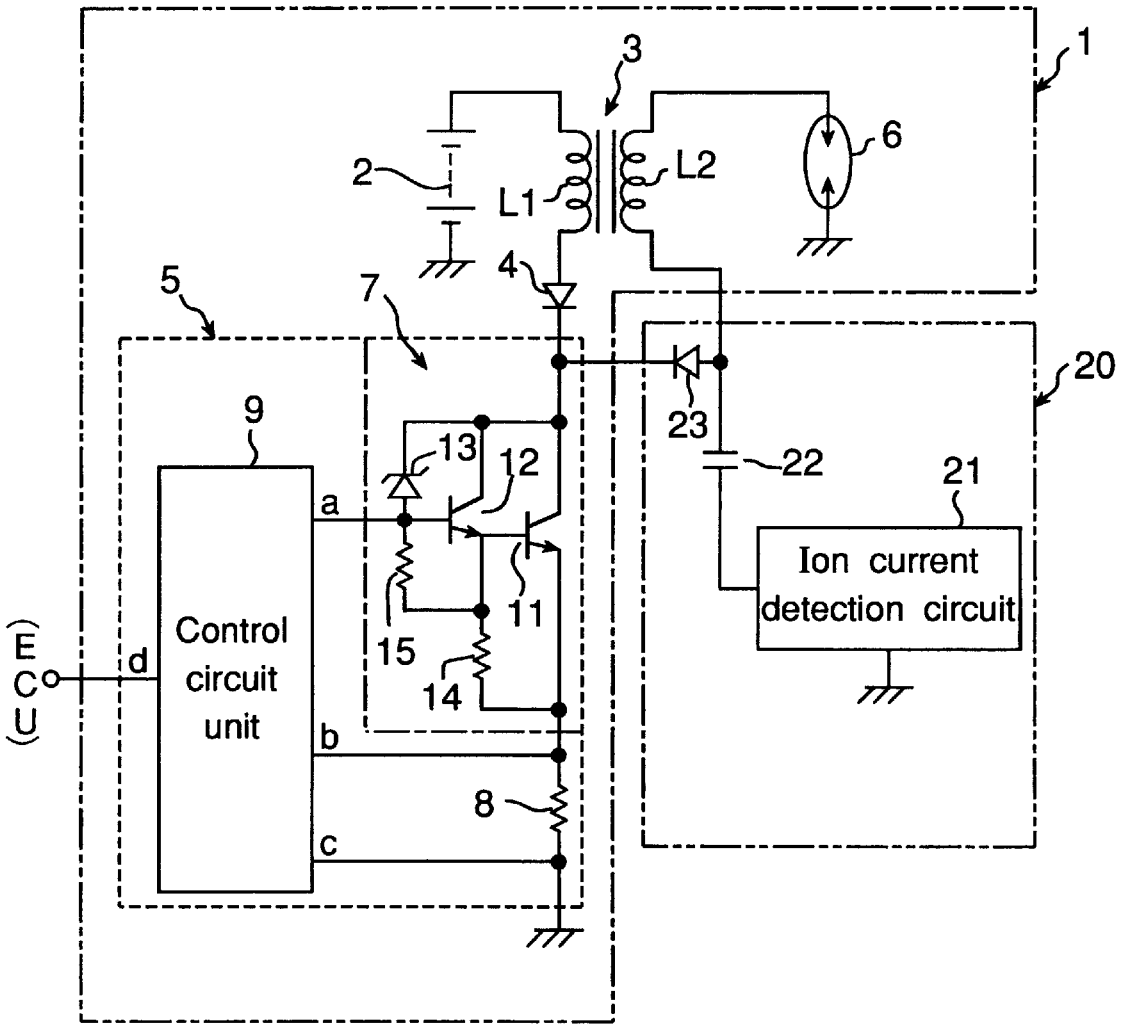
FIG. 1 is a circuit diagram of an ion current detection apparatus for an internal combustion engine according to a first embodiment of the present invention.

FIG. 1 is a circuit diagram of an ion current detection apparatus for an internal combustion engine according to a first embodiment of the present invention. As shown in FIG. 1, an ion current detection apparatus 20 is connected to an independently powered ignition apparatus 1. The ignition apparatus 1 comprises an automotive battery or other power source 2, an ignition coil 3, diode 4, ignition control circuit 5, and a spark plug 6 mounted in a cylinder. The ignition control circuit 5 comprises a switching circuit unit 7, resistor 8, and a control circuit unit 9 for controlling the switching circuit unit 7.

The switching circuit unit 7 comprises npn power transistors 11 and 12 in a compound connection, zener diode 13, and resistors 14 and 15.

The ion current detection apparatus 20 comprises an ion current detection circuit unit 21 for detecting an ion current, a capacitor 22, and a diode 23.

Referring to the ignition apparatus 1, current is supplied from the power source 2 to one end of the primary coil L1 of the ignition coil 3; the other end of the primary coil L1 is grounded through the diode 4 and ignition control circuit 5. One end of the secondary coil L2 of the ignition coil 3 is grounded through the spark plug 6, and the other end is connected to the ion current detection apparatus 20, that is, to one side of the capacitor 22 and to the anode of diode 23. The cathode of diode 23 is connected to the interconnect between the cathode of diode 4 and the cathode of zener diode 13 and the collectors of power transistors 11 and 12. The other side of capacitor 22 is connected to the ion current detection circuit unit 21.

Note that in this ignition control circuit 5 the collectors of power transistors 11 and 12 are interconnected, and this interconnect is connected to the cathodes of diode 4 and 23. The emitter of power transistor 12 is connected to the base of power transistor 11, and the emitter of power transistor 11 is grounded via resistor 8. The base of power transistor 12 is connected to an output a of the control circuit unit 9. Resistor 14 is connected between the base and emitter of power transistor 11, and resistor 15 is connected between the base and emitter of power transistor 12.

The cathode of zener diode 13 is connected to the collector of power transistor 12, and the anode is connected to the base of power transistor 12, to protect the power transistors 11 and 12 from the counterelectromotive force of the primary coil L1 of the ignition coil 3. The interconnect between resistor 8 and the-emitter of power transistor 11 is connected to input b of the control circuit unit 9, and the ground side of resistor 8 is connected to input c of the control circuit unit 9. A control signal from an engine control unit (not shown in the figures) is supplied to input d of the control circuit unit 9. The engine control unit controls the ignition timing based on information about current engine operation. As a result, the control circuit unit 9 controls switching the power transistors 11 and 12 on and off based on the control signal supplied from the engine control unit.

Figure 2:
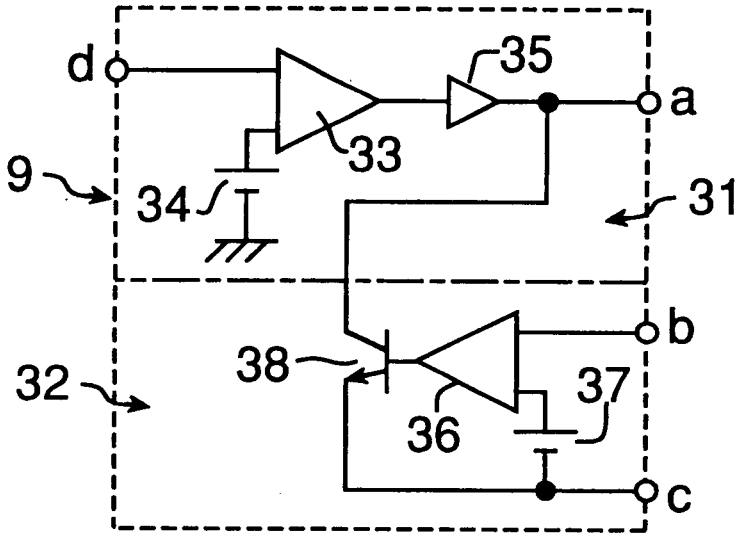
FIG. 2 is a circuit diagram of an exemplary control circuit unit 9 in FIG. 1.

FIG. 2 is a circuit diagram of an exemplary control circuit unit 9. As shown in FIG. 2, the control circuit unit 9 comprises a switching control circuit 31, and a current limiting circuit 32.

The switching control circuit 31 comprises a comparator 33, reference voltage generator 34, and drive circuit 35, and is used for controlling the on/off switching operation of the power transistors 11 and 12 according to a control signal input from the engine control unit (ECU below).

The current limiting circuit 32 comprises an operational amplifier (op-amp) 36, reference voltage generator 37, and npn transistor 38. The current limiting circuit 32 is used for limiting the emitter current of the power transistor 11 according to a voltage converted from the emitter current of the power transistor 11 by resistor 8.

One input to comparator 33 of switching control circuit 31 is input d of the control circuit unit 9, and is therefore connected to the ECU. Between the other input to the comparator 33 and the ground is connected the reference voltage generator 34. The output of comparator 33 is connected to the input of the drive circuit 35. The output of the drive circuit 35 is output a of the control circuit unit 9, is therefore connected to the base of power transistor 12.

One input to the op-amp 36 of current limiting circuit 32 is input b of control circuit unit 9, and is therefore connected to the interconnect between resistor 8 and the emitter of power transistor 11. The reference voltage generator 37 is connected between the other input to the op-amp 36 and input c of the control circuit unit 9. The output of op-amp 36 is connected to the base of npn transistor 38; the collector of npn transistor 38 is connected to output a of control circuit unit 9, and the emitter of npn transistor 38 is connected to input c of control circuit unit 9.

The control signal from the ECU is wave shaped based on a reference voltage input from the reference voltage generator 34 by means of comparator 33. The drive circuit 35 supplies the current required to switch power transistors 11 and 12 on to the base of the power transistor 12 according to the wave-shaped signal. The emitter current of the power transistor 11 is converted to a voltage by resistor 8. The op-amp 36 then compares this converted voltage against the reference voltage supplied from the reference voltage generator 37. If the emitter current of the power transistor 11 exceeds a specific value, npn transistor 38 becomes on, thus passing the base current supplied from the drive circuit 35 to power transistor 12 to the ground and limiting the emitter current of the power transistor 11.

By thus switching power transistors 11 and 12 on based on a control signal from the ECU, a current of several amperes to more than ten amperes flows to the primary coil L1 of the ignition coil 3. After current is thus supplied to the primary coil L1 for a specific time and the power transistors 11 and 12 are then switched off in response to a control signal from the ECU, the current supply to the primary coil L1 is suddenly interrupted, causing a counterelectromotive force to occur at the interconnect between the primary coil L1 and the collectors of power transistors 11 and 12. Note, however, that zener diode 13 normally limits the voltage supply between the collector and base of the power transistor 12 to approximately 300 to 400 V.

When a counterelectromotive force occurs at the primary coil L1 of the ignition coil 3, a voltage proportional to the winding ratio between the primary coil L1 and secondary coil L2 occurs at the secondary coil L2. For example, because the number of windings in the secondary coil L2 is approximately 100 times the number of windings in the primary coil L1, a voltage of approximately 30 kV occurs at the secondary coil L2. The secondary coil L2 is connected such that a negative voltage occurs on the spark plug 6 side of the coil, and a positive voltage occurs on the side on which the capacitor 22 is connected.

If the voltage stored by the capacitor 22 is less than or equal to the zener voltage of the zener diode 13 (more precisely, less than or equal to the sum of the zener voltage and the forward voltage of the diode 23, but the forward voltage of the diode 23 is ignored herein because it is small compared to the zener voltage of the zener diode 13) when the spark plug 6 sparks, a current of several ten milliamperes to a hundred and several ten milliamperes flows to the capacitor 22; if said stored voltage exceeds the zener voltage, the current flows from the cathode to the anode of zener diode 13.

As a result of this operation, the potential on one end of the secondary coil L2 of ignition coil 3 is limited to the zener voltage of the zener diode 13 or less. The electrode potential on the secondary coil L2 of the spark plug 6 is thus approximately −30 kV, a voltage of 30 kV is produced between the electrodes of the spark plug 6, and an electric spark is produced. This electric spark causes the air and fuel mixture inside the cylinder to combust, and molecules in the high temperature environment resulting from combustion inside the cylinder to ionize. When a voltage is then applied to this ionized gas, an ion current flows. Minute changes in this ion current occur with changes in the combustion state inside the cylinder, and the combustion state and other information can be detected by detecting this ion current.

After sparking and ignition occur, the counterelectromotive force at the side coil L1 of the ignition coil 3 quickly attenuates, there is simultaneously a rapid voltage drop at both ends of the secondary coil L2, and the voltage at both ends of the secondary coil L2 drops ultimately to zero. The voltage stored in the capacitor 22 is then added to the potential of the secondary coil L2, becomes approximately equal to the zener voltage of the zener diode 13 as a result of the ignition operation, and a voltage equal to the zener voltage of the zener diode 13 is applied to the spark plug 6.

When a voltage comparable to the stored charge of the capacitor 22 is applied to the spark plug 6 inside a cylinder containing ionized combustion gases immediately after ignition, an ion current flows. Because capacitor 22 supplies the charge producing this ion current, a current matching the ion current also flows to the ion current detection circuit unit 21 connected to the capacitor 22. The ion current detection circuit unit 21 detects this current, and the information contained in the ion current is processed.

Figure 3:
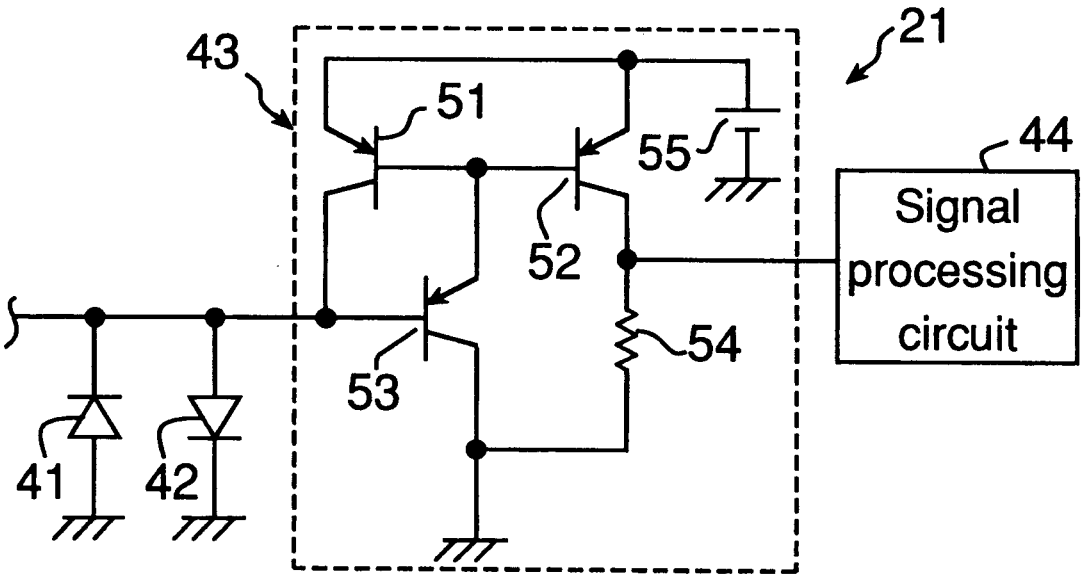
FIG. 3 is a circuit diagram of an exemplary ion current detection circuit unit 21 in FIG. 1.

FIG. 3 is a circuit diagram of an exemplary ion current detection circuit unit 21 in FIG. 1. As shown in FIG. 3, the ion current detection circuit unit 21 comprises diodes 41 and 42, an ion current-voltage conversion circuit 43 for converting the detected ion current to a voltage, and a signal processing circuit 44 for appropriately processing the voltage-converted signal output by the ion current-voltage conversion circuit 43. The ion current-voltage conversion circuit 43 comprises pnp transistors 51 to 53, resistor 54, and power supply circuit 55.

The pnp transistors 51 to 53 are connected to form a current mirror circuit. The bases of pnp transistors 51 and 52 are interconnected, and this interconnect is connected to the emitter of pnp transistor 53. The collector of pnp transistor 53 is grounded. The emitters of pnp transistors 51 and 52 are also interconnected, and this interconnect is connected to the power supply circuit 55. The collector of pnp transistor 51 is connected to the base of pnp transistor 53, the cathode of diode 41, and the anode of diode 42, and the interconnect therebetween is connected to capacitor 22. The anode of diode 41 and the cathode of diode 42 are grounded, the collector of pnp transistor 52 is grounded via the resistor 54, and the interconnect between the collector of pnp transistor 52 and resistor 54 is connected to the signal processing circuit 44.

The ion current-voltage conversion circuit 43 detects an ion current, and converts the detected ion current to a voltage. The power supply circuit 55 of the ion current-voltage conversion circuit 43 supplies a voltage, e.g., a supply voltage of 1.4 V, resulting in 0 V in the interconnect between the collector of pnp transistor 51 and the base of pnp transistor 53. The ion current thus flows from the collector of pnp transistor 51 to capacitor 22, through the secondary coil L2 of the ignition coil 3, and hence to the spark plug 6, and a current proportional to the ion current is supplied to the resistor 54 by the current mirror circuit comprising pnp transistors 51 to 53. Conversion of the ion current produces a signal that reflects variations in the voltage drop of the resistor 54, and the signal processing circuit 44 then appropriately processes the converted signal representing this variation in the voltage drop.

Figure 4:
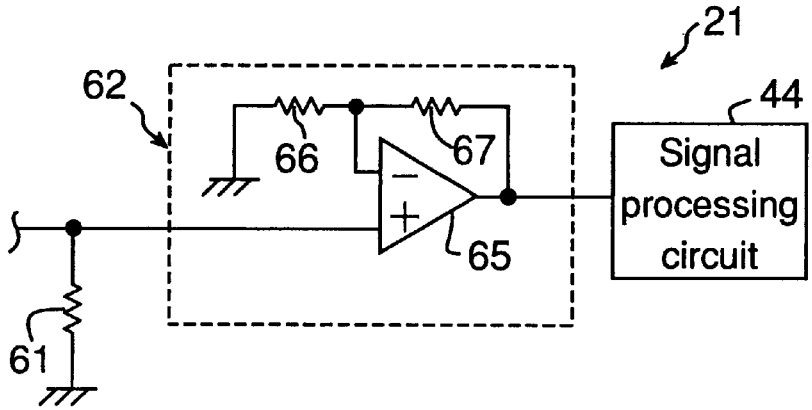
FIG. 4 is a circuit diagram of a further exemplary ion current detection circuit unit 21 in FIG. 1.
Figure 5:
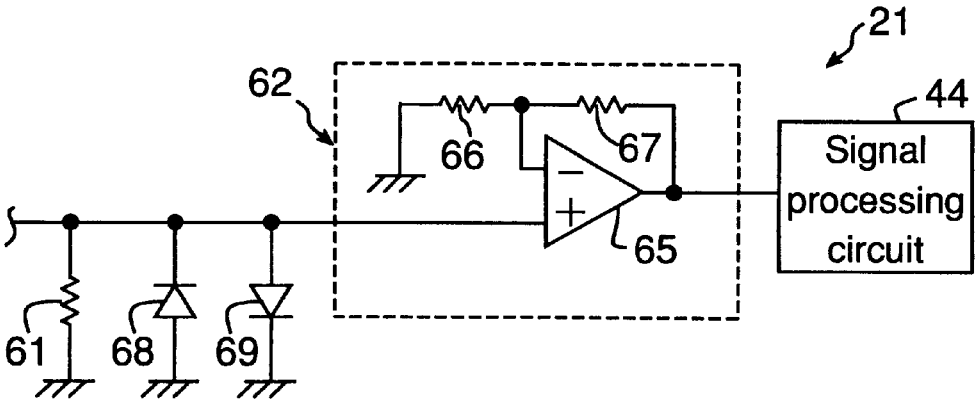
FIG. 5 is a circuit diagram of a yet further exemplary ion current detection circuit unit 21 in FIG. 1.
Figure 6:
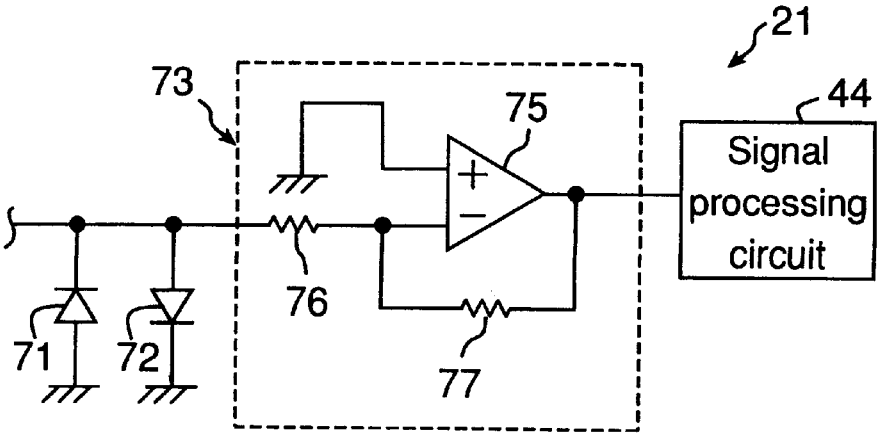
FIG. 6 is a circuit diagram of a yet further exemplary ion current detection circuit unit 21 in FIG. 1.

Other variations of the ion current detection circuit unit 21 are shown in FIG. 4 to FIG. 6. Each of these alternative circuit designs are known from the literature, and operation is therefore described briefly below. It should be noted that like parts in FIG. 4 to FIG. 6 are indicated by like reference numerals, and further description thereof is omitted below.

The ion current detection circuit unit 21 shown in FIG. 4 comprises a resistor 61 for detecting the ion current and converting the detected ion current to a voltage; an amplification circuit 62 for amplifying the voltage drop in the resistor 61 caused by the ion current, and a signal processing circuit 44 for specifically processing the signal amplified by the amplification circuit 62. The amplification circuit 62 comprises an operational amplifier (op-amp) 65, and resistors 66 and 67.

One side of resistor 61 is connected to capacitor 22, and the other is grounded. The op-amp 65 and resistors 66 and 67 form a non-inverting amplifier circuit. The inverting input of op-amp 65 is grounded through resistor 66, and connected to the output of the op-amp 65 via resistor 67. The non-inverting input of the op-amp 65 is connected to the interconnect between the capacitor 22 and resistor 61.

The ion current in this configuration is the current flowing when a positive voltage is applied to the spark plug 6. The ion current is thus grounded via resistor 61, causing a positive voltage drop in resistor 61. This voltage drop is amplified by the amplification circuit 62, and the signal processing circuit 44 then specifically processes the voltage signal of the amplified ion current.

A further ion current detection circuit unit 21 additionally comprises, as shown in FIG. 5 and compared with the design shown in FIG. 4, a diode 68 of which the cathode is connected to the interconnect between capacitor 22 and resistor 61 and the anode is grounded, and a diode 69 of which the anode is connected to the interconnect between capacitor 22 and resistor 61 and the cathode is grounded. As a result, a voltage drop in the resistor 61 can be suppressed to the forward voltage of diode 68 or 69. The voltage drop in the resistor 61 can therefore be reduced when excessive current is flowing during ion current signal processing, the resistance of the resistor 61 can be increased, and construction of the amplification circuit 62 and other components can be simplified.

A further ion current detection circuit unit 21 additionally comprises, as shown in FIG. 6 and compared with the design shown in FIG. 4, a diode 71 for outputting a current from the capacitor 22, a diode 72 for supplying a current to the capacitor 22, an amplification circuit 73, and a signal processing circuit 44 for specifically processing the signal amplified by the amplification circuit 73. The amplification circuit 73 comprises an operational amplifier (op-amp) 75, and resistors 76 and 77. The cathode of diode 71 is connected to the capacitor 22, and the anode is grounded. The anode of diode 72 is connected to the capacitor 22, and the cathode is grounded.

The op-amp 75 and resistors 76 and 77 form an inverting amplifier circuit. The non-inverting input of op-amp 75 is grounded. The inverting input of op-amp 75 is connected through resistor 76 to the interconnect between capacitor 22, the cathode of diode 71, and the anode of diode 72, and is further connected through resistor 77 to the output of the op-amp 75. This design has been previously disclosed in Japanese Patent Laid-Open Publication H7-217519 (1995-217519). The ion current represents a voltage drop in the resistor 77, is converted to a ground reference signal, and a voltage proportional to the ion current is output from the op-amp 75. By shorting resistor 76 or sufficiently lowering the resistance thereof, the current-voltage conversion ratio can be increased while the input impedance of the ion current detection circuit unit 21 is low as a result of an imaginary short in the op-amp 75. As a result, resistance to the effects of stray capacitance in, for example, the wiring can be improved.

Figure 7:
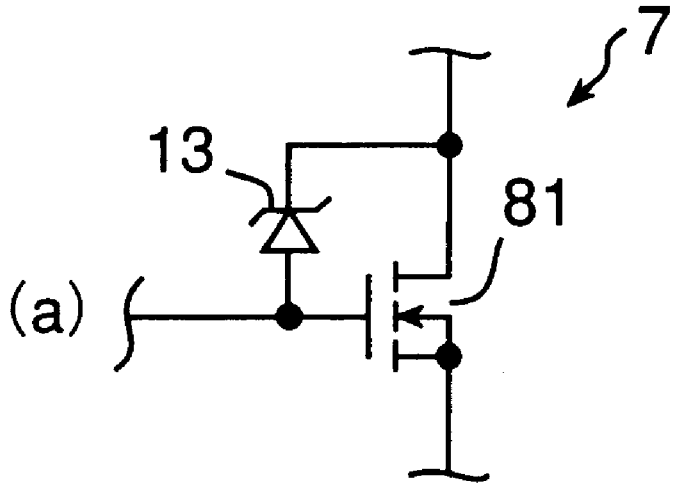
FIG. 7 is a circuit diagram of a further exemplary switching circuit unit 7 in FIG. 1.

It should be noted that in the first embodiment described above power transistors 11 and 12 are used in switching circuit unit 7 of the ignition control circuit 5, and a current of several ten milliamperes must be supplied to the base of the power transistor 12 to drive the switching operation of the power transistors 11 and 12. As a result, a power MOSFET can be substituted for the power transistors 11 and 12. A circuit diagram of a switching circuit unit 7 in which a power MOSFET is used is shown in FIG. 7. Note that the power transistors 11 and 12 of the switching circuit unit 7 shown in FIG. 1 are replaced by an NMOS transistor 81. As a result, the drive current required by the switching circuit unit 7 can be reduced.

Figure 8:
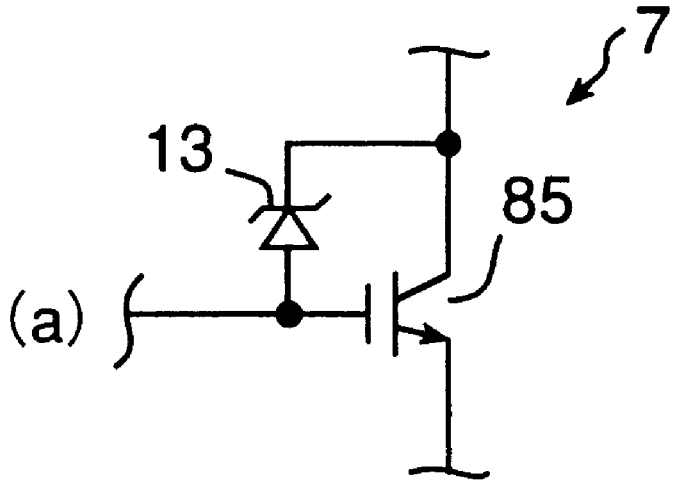
FIG. 8 is a circuit diagram of a yet further exemplary switching circuit unit 7 in FIG. 1.

An IGBT can be further used in place of the power transistors 11 and 12, and a circuit diagram of a switching circuit unit 7 in which an IGBT is used is shown in FIG. 8. Note that the power transistors 11 and 12 of the switching circuit unit 7 shown in FIG. 1 are replaced by an IGBT 85. As is possible when a power MOSFET is substituted for the power transistors 11 and 12, the drive current required by the switching circuit unit 7 can be reduced by using an IGBT. In addition, an IGBT can carry more current than even a power MOSFET, and a small IGBT element can therefore be used. As a result, the size of the switching circuit unit 7 can be further reduced from that when a power MOSFET is used.

An independently powered ignition apparatus was used by way of example only in the first embodiment above, and the present invention can also be used with an ignition apparatus connected to a high voltage power source.

Figure 9:
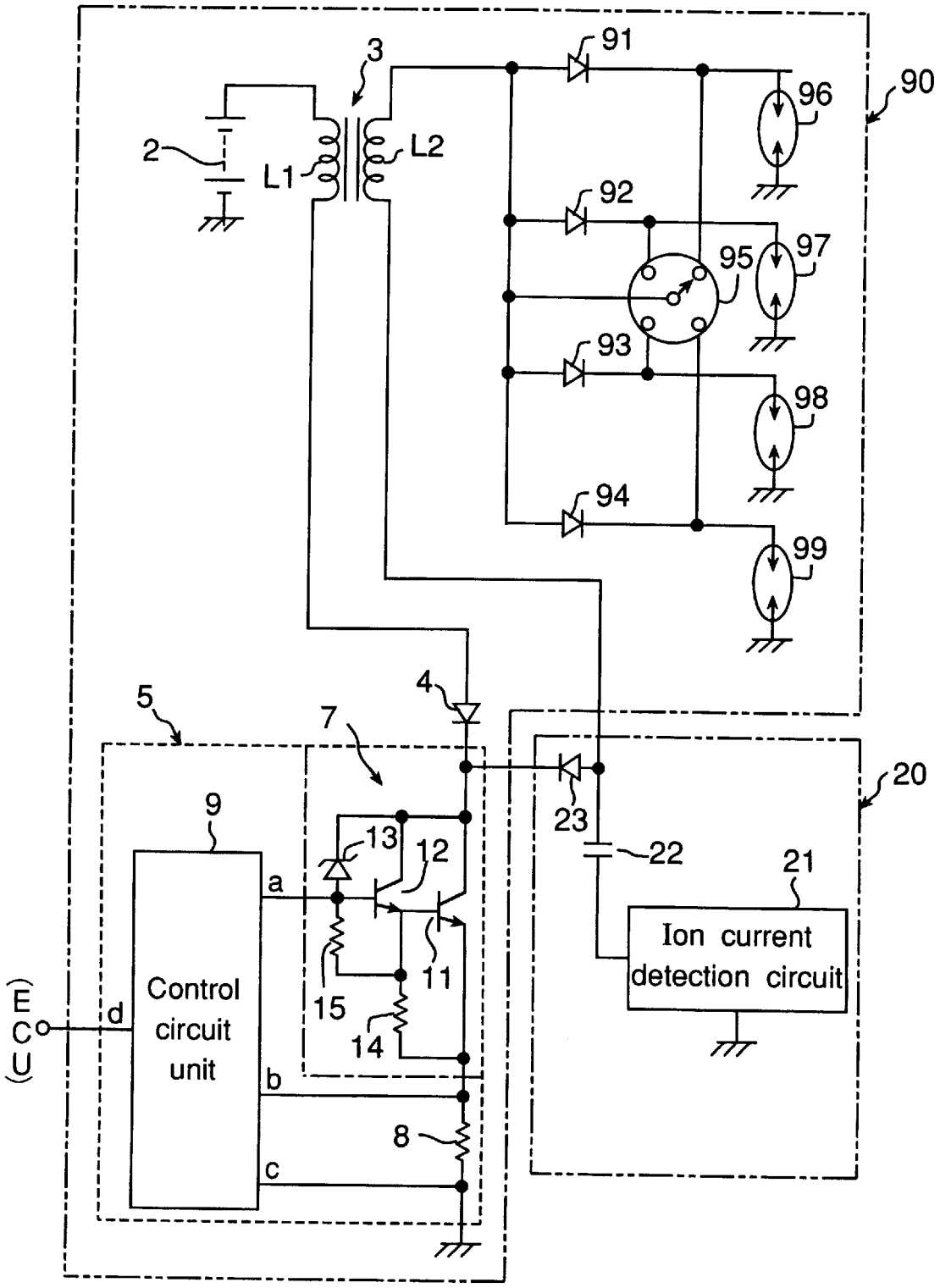
FIG. 9 is a circuit diagram of an ion current detection apparatus for an internal combustion engine according to an alternative embodiment of the present invention.
Figure 10:
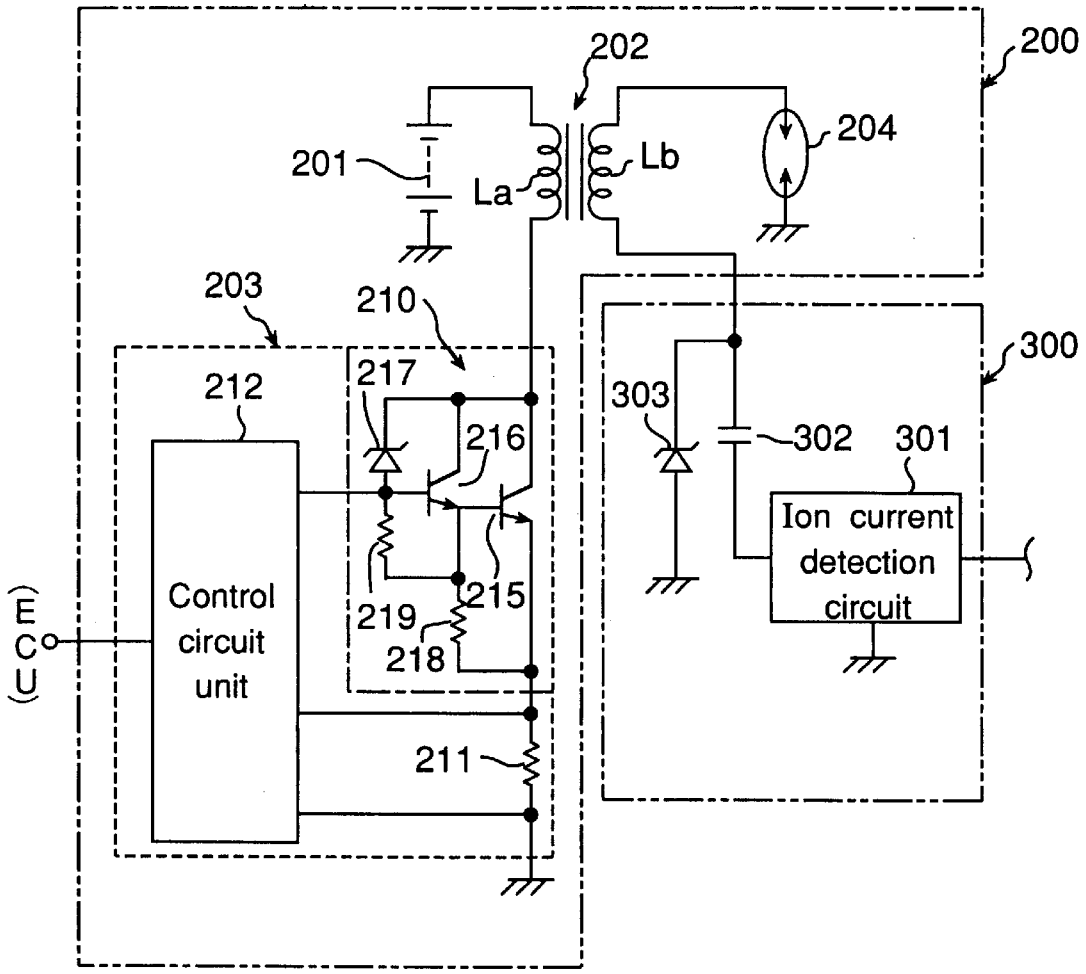
PRIOR ART Fig.10
FIG. 10 is a circuit diagram of an ion current detection apparatus for an internal combustion engine according to the related art.

FIG. 9 is a circuit diagram of an alternative embodiment of an ion current detection apparatus for an internal combustion engine according to the present invention. Note that this ion current detection apparatus is used with an ignition apparatus connected to a high voltage circuit for a four-cylinder engine, and is the ion current detection apparatus shown in FIG. 1 adapted for this application. Like parts are therefore identified by like reference numerals, and further description thereof is omitted below, where the differences only are described.

The apparatus shown in FIG. 9 differs from that in FIG. 1 in that the spark plug 6 in FIG. 1 is replaced by diodes 91 to 94, distributor 95, and spark plugs 96 to 99. As a result, the ignition apparatus 1 shown in FIG. 1 is labelled ignition apparatus 90 in FIG. 9. The ignition apparatus 90 shown in FIG. 9 thus comprises an automotive battery or other power source 2, ignition coil 3, diode 4, diodes 91 to 94, ignition control circuit 5, distributor 95, and spark plugs 96 to 99.

One end of the secondary coil L2 of the ignition coil 3 is connected to the anodes of diodes 91 to 94 and to the rotor of the distributor 95. The cathodes of diodes 91 to 94 are connected to the corresponding terminals of the distributor 95. The cathode of diode 91 is grounded to spark plug 96, the cathode of diode 92 is grounded to spark plug 97, the cathode of diode 93 is grounded to spark plug 98, and the cathode of diode 94 is grounded to spark plug 99.

The high voltage charge occurring at the secondary coil L2 of the ignition coil 3 is thus distributed to the spark plugs 96 to 99 by the distributor 95. The spark plugs 96 to 99 are discharged by a negative voltage as described in the first embodiment above, and when sparking is completed, a voltage is applied from diodes 91 to 94 to the corresponding spark plugs 96 to 99 to enable ion current detection as described with reference to FIG. 1 above. It will thus be obvious that as described above a ion current detection apparatus 20 according to the first embodiment of the invention can be used in conjunction with a variety of different ignition apparatuses.

Furthermore, an ion current detection apparatus for an internal combustion engine according to the first embodiment of the invention can use the zener diode 13 that protects the switching elements of the switching circuit unit 7 in the ignition control circuit 5 from a counterelectromotive force produced by the ignition coil 3 for limiting the voltage of the capacitor 22 used for ion current supply. As a result, the need for zener diodes with a heat resistance and radiation structure sufficient to withstand a large power loss is eliminated, and cost can be reduced.

As described above, a voltage limiting means for limiting the counterelectromotive force of a primary coil acting on a switching element used for supplying current to the primary coil can also be used for limiting the voltage of a capacitor used for ion current supply. As a result, the voltage limiting means conventional disposed to the ion current supply capacitor can be eliminated, and cost can be reduced.

The voltage limiting means can further limit the voltage applied to a capacitor during charging by the current supplied for sparking by the spark plug. As a result, the need for zener diodes with a heat resistance and radiation structure sufficient to withstand a large power loss is eliminated, and cost can be reduced.

The connecting means for connecting said capacitor to the voltage limiting means can be specifically achieved using two diodes, thereby achieving the connecting means using inexpensive elements and a simple circuit design.

Furthermore, by specifically using a zener diode for the voltage limiting means, the need for a zener diode with a heat resistance and radiation structure sufficient to withstand a large power loss is eliminated, and cost can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ion current detection apparatus for detecting an ion current occurring during combustion in an internal combustion engine, wherein said internal combustion engine comprises an ignition coil for generating a high voltage charge on a secondary coil thereof by means of a voltage applied to a primary coil thereof, and a spark plug for igniting fuel inside an engine cylinder as a result of the high voltage generated in the ignition coil, said ion current detection apparatus comprising:

a voltage limiting device isolated from said secondary coil and adapted to limit an amount of a counterelectromotive force of said primary coil applied to a switching element used for controlling a current supply to the primary coil;

a capacitor for applying an ion current detection voltage to the spark plug via the secondary coil;

an ion current detection means for detecting an ion current based on a voltage applied from said capacitor to the spark plug; and a connecting means for connecting said capacitor to the voltage limiting device;

wherein the voltage limiting device is used for capacitor voltage limiting.

2. The ion current detection apparatus for an internal combustion engine according to claim 1, wherein:

said capacitor is charged by current flowing during sparking of said spark plug, and said capacitor discharges the stored voltage charge to said spark plug immediately after sparking is completed, and said voltage limiting device limits a voltage supplied to said capacitor during capacitor charging.

3. The ion current detection apparatus for an internal combustion engine according to claim 1, wherein:

said connecting means comprises a first diode configured to connect said primary coil and said switching element, and a second diode configured to connect said capacitor and said voltage limiting device.

4. The ion current detection apparatus for an internal combustion engine according to claim 1, wherein:

said voltage limiting device is a zener diode.

5. An ion current detection apparatus for detecting an ion current occurring during combustion in an internal combustion engine, wherein said internal combustion engine comprises an ignition coil for generating a high voltage charge on a secondary coil thereof by means of a voltage applied to a primary coil thereof, and a spark plug for igniting fuel inside an engine cylinder as a result of the high voltage generated in the ignition coil, said ion current detection apparatus comprising:

a voltage limiting means isolated from said secondary coil and adapted to limit an amount of a counterelectromotive force of said primary coil applied to a switching element used for controlling current supply to the primary coil;

a capacitor for applying an ion current detection voltage to the spark plug via the secondary coil;

an ion current detection means for detecting an ion current based on a voltage applied from said capacitor to the spark plug; and a connecting means for connecting said capacitor to the voltage limiting means;

wherein the voltage limiting means is used for capacitor voltage limiting.

6. The ion current detection apparatus for an internal combustion engine according to claim 5, wherein:

said capacitor is charged by current flowing during sparking of said spark plug, and said capacitor discharges the stored voltage charge to said spark plug immediately after sparking is completed, and said voltage limiting means limits a voltage supplied to said capacitor during capacitor charging.

7. The ion current detection apparatus for an internal combustion engine according to claim 5, wherein:

said connecting means comprises a first diode configured to connect said primary coil and said switching element, and a second diode configured to connect said capacitor and said voltage limiting device.

8. An ion current detection apparatus for detecting an ion current occurring during combustion in an internal combustion engine, wherein said internal combustion engine comprises an ignition coil for generating a high voltage charge on a secondary coil thereof by means of a voltage applied to a primary coil thereof, and a spark plug for igniting fuel inside an engine cylinder as a result of the high voltage generated in the ignition coil, said ion current detection apparatus comprising:

a zener diode adapted to limit an amount of a counter-electromotive force of said primary coil applied to a switching element used for controlling a current supply to the primary coil;

a capacitor configured to apply an ion current detection voltage to the spark plug via the secondary coil and being connected to said zener diode;

an ion current detector configured to detect an ion current based on a voltage applied from said capacitor to the spark plug; and wherein the zener diode is used for capacitor voltage limiting.

9. The ion current detection apparatus for an internal combustion engine according to claim 8, wherein:

said capacitor is charged by current flowing during sparking of said spark plug, and said capacitor discharges the stored voltage charge to said spark plug immediately after sparking is completed, and said zener diode limits a voltage supplied to said capacitor during capacitor charging.

10. The ion current detection apparatus for an internal combustion engine according to claim 8, wherein:

said capacitor is connected to said zener diode by a first diode configured to connect said primary coil and said switching element, and a second diode configured to connect said capacitor and said zener diode.

* * * * *